United States Patent [19]

Hebden et al.

[11] Patent Number: 4,487,612

[45] Date of Patent: Dec. 11, 1984

[54] COAL GASIFICATION PLANT

[75] Inventors: Dennis Hebden, Wareham, England; Charles T. Brooks, Kinross, Scotland

[73] Assignee: British Gas Corporation, London, England

[21] Appl. No.: 409,534

[22] Filed: Aug. 19, 1982

[30] Foreign Application Priority Data

Oct. 27, 1981 [GB] United Kingdom ..... 8132336

[51] Int. Cl.[3] ..... B01J 3/00; C10J 3/48

[52] U.S. Cl. ..... 48/77; 48/62 R; 48/87; 48/DIG. 2

[58] Field of Search ..... 48/DIG. 2, 62 R, 77, 48/87, 63; 266/236; 164/335, 336, 337; 222/594, 591, 592; 110/165 R, 225, 229, 230, 231

[56] References Cited

U.S. PATENT DOCUMENTS 4,192,654 3/1980 Brooks ..... 48/DIG. 2

FOREIGN PATENT DOCUMENTS 1569297 6/1980 United Kingdom ..... 48/DIG. 2

835636 7/1979 U.S.S.R. ..... 222/591

*Primary Examiner*—Peter Kratz

*Assistant Examiner*—Joye L. Woodard

*Attorney, Agent, or Firm*—Larson and Taylor

[57] ABSTRACT

A slagging gasifier has a hearth comprising an annular solid cast structure formed from a high thermal conductivity metal such as copper and shaped to fit above a slag tap of the gasifier. The hearth is provided with one or more integrally formed passageways for circulating a coolant liquid therethrough and has an upper tundish surface with a slope of at least 10° to the horizontal (preferably between 25° and 45°), across which tundish surface the molten slag flows downwardly and inwardly towards to slag tap. The annular structure may be formed from at least three sector-shaped cast parts secured together in situ in the gasifier.

9 Claims, 3 Drawing Figures

COAL GASIFICATION PLANT

This invention relates to coal gasification plant, and more particularly to coal slagging gasifier plants of the kind in which coal, or other carbonaceous fuel, is introduced into the top of a column-like gasifying vessel and is gasified under high pressure and temperature by means of a gas, for example oxygen and steam, introduced into the fuel bed through tuyeres. The residual ash collects as a molten slag and iron in the hearth of the gasifier vessel from which it is discharged (commonly known as slag-tapping) downwardly through a slag tap outlet or orifice in the hearth into water contained in a quenching chamber vessel. Usually, a pool of molten slag and iron is maintained in the hearth by directing hot combustion products from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber and the gasifier vessel.

During the operation of such a slagging gasifier, the slag tap and hearth are subject to aggressive erosion, corrosion and thermal attack by the molten slag and iron. High temperature and mobility of the slag and iron during slag-tapping and slag-retention operations make the containment materials of the slag-tap and its immediate hearth areas primarily subject to erosion and thermal attack.

Our UK Pat. No. 1,569,297 describes a slagging gasifier in which the slag removal orifice is located centrally within the gasifier hearth which includes a removable annular hearth member located so as to fit over and around the slag tap orifice and comprising a solid mass of high thermal conductivity material having an integral passageway for circulating a coolant liquid through said mass and an inlet and outlet communicating said passageway exteriorly of the mass.

An object of the present invention is to provide an improved hearth arrangement for a slagging gasifier.

According to the present invention a slagging gasifier comprises a gasifying vessel, means for introducing coal or other carbonaceous fuel into the vessel for gasification thereof, means for introducing a gasifying medium into the vessel to effect gasification of the fuel therein, and a hearth located at the bottom of the vessel and including a liquid cooled slag tap member having a slag removal orifice for removing molten slag from the vessel, wherein the hearth comprises an annular solid cast structure formed preferably from high thermal conductivity metal shaped to fit above the slag tap member and having means defining one or more integrally formed passageways for circulating a coolant liquid through said structure, said structure also having an upper tundish surface with a slope of at least 10° to the horizontal across which tundish surface the molten slag flows downwardly and inwardly towards the slag tap member.

Preferably the slope of the upper tundish surface of the annular structure is between 25° and 45° to the horizontal and has substantially the same slope as a upper tundish surface of the slag tap member.

Conveniently, the annular structure is formed from a plurality of separate cast parts secured together in situ.

The annular structure may be formed from at least three sector-shaped cast parts secured together in situ.

The annular structure may also include a separate annular part located adjacent the slag tap member and secured to the remainder of the annular structure in situ.

The resistance to erosion of the annular structure and the slag tap member depends on critical factors of design, involving, among other things, the thermal conductivity of the material used, the shape and geometry of its metal mass, the size and shape of the orifice, and the size, length and location of the coolant passageways with respect to the surfaces exposed to thermal attack.

The amount and rate of flow of coolant liquid is also an important factor in the design of the annular structure and slag tap member since the exposed surfaces must be cooled efficiently to maintain acceptable surface temperatures, but on the other hand it is important that excessive quantities of heat are not removed from the hearth. Typically, coolant liquid flow velocities of the order of 20–30 ft/sec are preferred to give a constant passageway wall temperature.

Preferably, the slag tap member and the annular structure are formed of copper or a copper alloy.

The upper tundish surface may be covered with a layer of refractory material, for example at least one course of refractory bricks.

The invention will now be described, by way of example, with reference to the accompanying diagrammatic drawings, in which.

Figure 1:
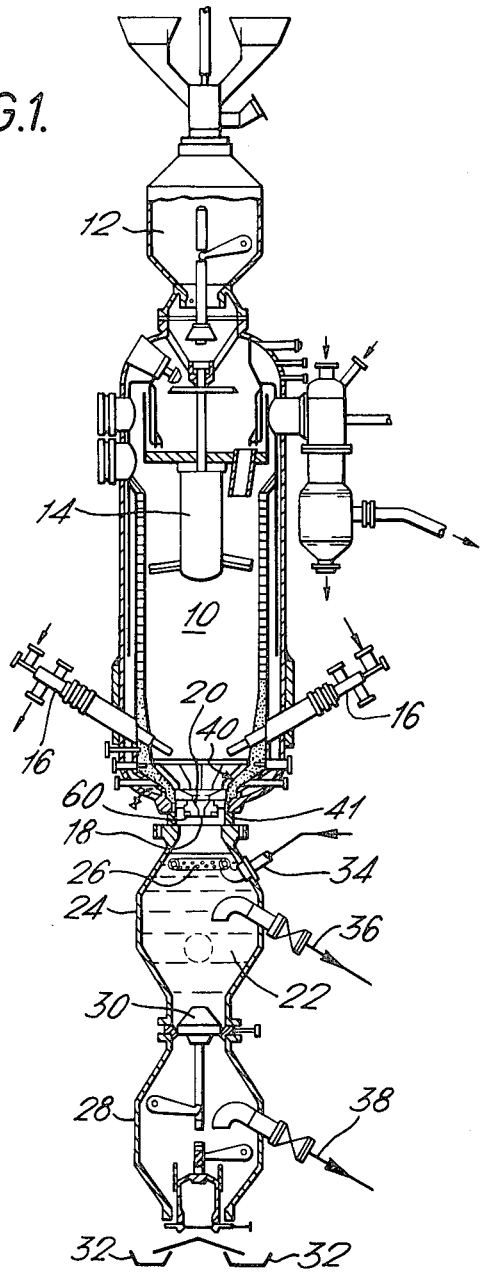
FIG. 1 is a general longitudinal sectional elevation of a fixed-bed slagging gasifier incorporating a hearth arrrangement in accordance with the invention.

Referring in the first instance to FIG. 1, the gasifier has a refractory-lined pressurised gasification chamber 10 into which coal or other carbonaceous fuel is fed from a lock hopper 12 and distributed by a rotatable distributor 14. A gasification medium, for example, oxygen and steam is introduced into the fuel bed (not shown) through tuyeres 16 to promote gasification of the fuel. In use of the gasifier, a reservoir of molten slag collects in the bottom of the chamber 10 and is periodically passed, via an orifice 18 in a slag outlet or slag tap member 20, into a water reservoir 22 contained in a quenching chamber 24 where it is rapidly quenched in a region of turbulent water issuing from a perforated tubular ring 26 before being transferred to a lock hopper 28, upon operation of a valve 30, in the form of a dense small-grained frit entrained with some of the quenching water. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 28 respectively by pump and filter means (not shown). In accordance with the invention the region of the hearth surrounding the slag tap 20 is provided with an annular hearth structure 40.

Figure 2:
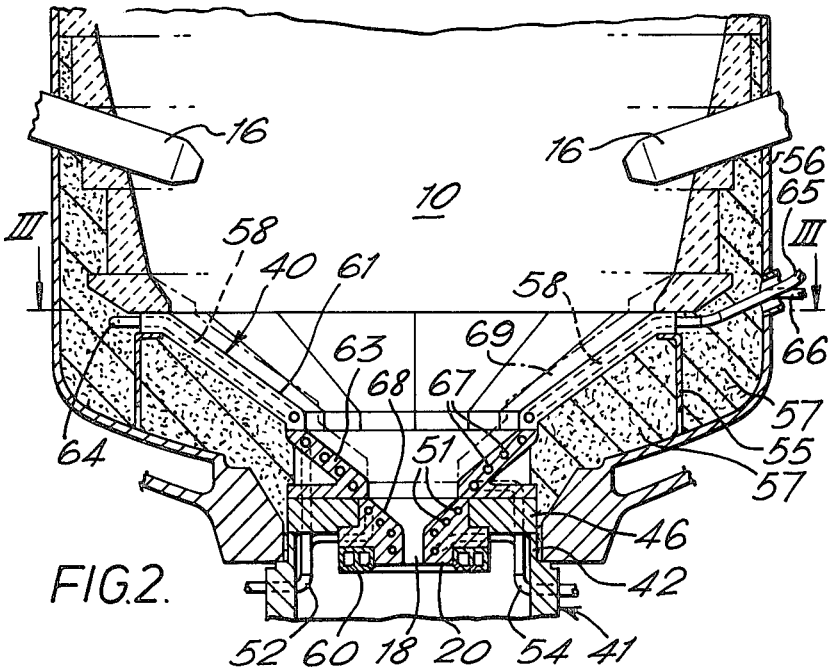
FIG. 2 is a longitudinal sectional elevation of a hearth arrangement shown in FIG. 1, but drawn to a larger scale than that Figure.

Referring also to FIG. 2, the quenching chamber 24 is secured in a gas-tight manner to the bottom of the gasification chamber 10 through the intermediary of a removable sandwich flange assembly 41 which consists of a cylindrical steel sleeve 42 having a steel annular block 46 welded to its upper end. The slag tap member 20 is supported by the block 46 by means of bolts (not shown). Coolant water is fed to coiled waterways 51 formed in the slag tap member 20 through inlet and outlet pipes 52, 54 which pass through the block 46.

The annular hearth structure 40 is shaped to fit within the bottom of the gasification chamber 10 above the slag tap member 20 and is secured in this position by a metal support ring 55. The spaces between the annular structure 40 and the wall 56 of the chamber 10 and between the support ring 55 and the wall 56 of the chamber are filled with bubbled alumina filler material 57. The annular structure 40 is formed preferably from a high thermal conductivity metal such as copper or a copper alloy which is cast round a nickel-chrome alloy pipe to provide passageways 58 for circulating a coolant liquid.

Figure 3:
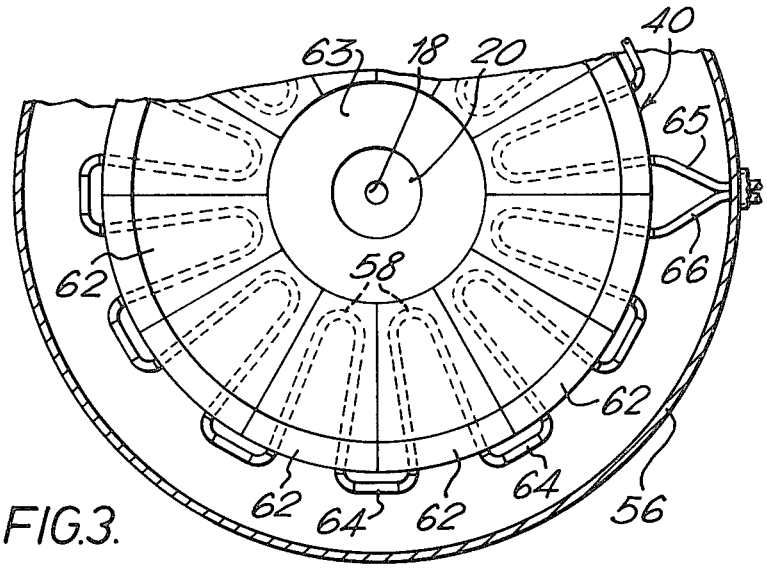
FIG. 3 is a fragmentary sectional plan view taken on the line III—III in FIG. 2.

The annular structure has an upper tundish surface 61 which slopes downwardly and inwardly towards the slag tap member at an angle of substantially 36° to the horizontal. As can be seen more clearly in FIG. 3 the annular structure comprises twelve substantially sector shaped parts 62 secured together around a central annular part 63. The inner periphery of the annular part 63, which is at its lowermost end, rests on the uppermost end of the tundish surface 68 of the slag tap member 20.

Substantially U-shaped passageways 58 for the coolant liquid extend through each of the sector-shaped parts 62 and are connected in series by supply pipes 64 at the outer ends of the passageways 58 and are provided with inlet and outlet pipes 65 and 66 for the supply and discharge of coolant liquid. The central annular part 63 is provided with a spirally coiled passageway 67 for the coolant liquid which is supplied through inlet pipe 52 and discharged through outlet pipe 54.

The slope of the upper tundish surface 61 of the annular structure 40 is substantially the same as the slope of the upper tundish surface 68 of the slag tap member 20. The tundish surface 61 of the annular structure 40 including the surface formed by the annular part 63 may be covered by at least one course of sector-shaped refractory bricks 69 preferably of silicon carbide based material (shown in chain-dotted lines).

It has been found that the efficient cooling of the hearth provided by the annular structure 40 not only retards the wear of the refractory material 69 but also enables the apparatus to continue to operate when the refractory material has been substantially worn away. In these circumstances it has been shown by practical experience that a layer of frozen slag is formed on the upper tundish surface 40 which protects the copper or copper alloy from attack by molten iron and that the cooling can maintain this layer under all normal operating conditions. Moreover, the relatively steep angle of the upper tundish surface, preferably having a slope between 25° and 45° to the horizontal, enables molten iron to be rapidly shed through the slag tap member 20 which also has an upper tundish surface with a similar relatively steep angle.

We claim:

1. A slagging gasifier comprising:

a gasifying vessel;

means for introducing coal or other carbonaceous fuel into the vessel for gasification thereof;

means for introducing a gasifying medium into the vessel to effect gasification of the fuel therein;

a hearth including a liquid cooled slag tap member located centrally at the bottom of the hearth and having a slag removal orifice for removing molten slag from the vessel;

the improvement wherein the remaining area of the hearth surmounting said slag tap is provided with an annular structure formed from a plurality of separate annular sector-shaped cast parts made of high thermal conductivity metal which are secured together in situ so as to fit above and around said slag tap member;

said structure having means defining at least one integrally formed passageway for circulating a coolant liquid through said structure; and said structure also having an upper tundish surface with a slope of at least 10° to the horizontal across which tundish surface the molten slag flows downwardly and inwardly towards the slag tap member.

2. A slagging gasifier as claimed in claim 1, wherein the slope of the upper tundish surface of the annular structure is between 25° and 45° to the horizontal.

3. A slagging gasifier as claimed in claim 1, wherein the slope of the upper tundish surface of the annular structure has substantially the same slope as an upper tundish surface of th slag tap member.

4. A slagging gasifier as claimed in claim 1, wherein the annular structure is formed from at least three sector-shaped cast parts secured together in situ.

5. A slagging gasifier as claimed in claim 1, wherein the annular structure is formed from twelve sector-shaped cast parts secured together in situ.

6. A slagging gasifier as claimed in claim 1, wherein the annular structure further includes a separate annular element located immediately below said annular sector-shaped cast part and supra-adjacent said slag tap member and secured to the remainder of the annular structure in situ.

7. A slagging gasifier as claimed in claim 1, wherein the high thermal conductivity metal from which the annular structure is formed is copper or a copper alloy.

8. A slagging gasifier as claimed in claim 1, wherein the upper tundish surface of the annular structure is covered with a layer of refractory material.

9. A slagging gasifier as claimed in claim 1, wherein the upper tundish surface of the annular structure is covered with at least one course of refractory bricks.

* * * * *